US006896330B1

(12) United States Patent
Yu

(10) Patent No.: US 6,896,330 B1
(45) Date of Patent: May 24, 2005

(54) 360-DEGREE SWIVEL CUSHION

(76) Inventor: Ming-Ming Yu, 1F, No. 229-3, Jing-Kou Rd., Taoyuan City (TW)

( * ) Notice: Subject to any disclaimer, the term of this patent is extended or adjusted under 35 U.S.C. 154(b) by 0 days.

(21) Appl. No.: 10/715,357

(22) Filed: Nov. 19, 2003

(51) Int. Cl.[7] ..... A47C 1/02
(52) U.S. Cl. ..... 297/344.21; 297/344.26; 248/349.1
(58) Field of Search ..... 297/240, 242, 297/344.21, 344.26, 461, 218.1, 228.1; 248/349.1, 248/415, 918

(56) References Cited

U.S. PATENT DOCUMENTS 1,732,113 A * 10/1929 Van Der Meer ..... 248/349.1
3,232,662 A * 2/1966 Graves ..... 297/119
4,117,627 A * 10/1978 Slingerland, Jr. ..... 47/39
5,580,129 A * 12/1996 Findlay ..... 297/344.21
5,716,096 A * 2/1998 Pryde et al. ..... 297/228.11
5,782,451 A * 7/1998 Carnahan et al. ..... 248/425
6,015,188 A * 1/2000 Yundt et al. ..... 297/344.21
6,447,065 B1 * 9/2002 Ropp ..... 297/344.21

* cited by examiner

*Primary Examiner*—Peter M. Cuomo
*Assistant Examiner*—Stephen Vu
(74) *Attorney, Agent, or Firm*—Bacon & Thomas PLLC

(57) ABSTRACT

A 360 degree swivel cushion includes a swivel ball seat configured between a swivel plate and a base plate. The steel balls are positioned within the swivel ball seat so that the cushion can slide on circular tracks configured on a base of the swivel plate. A cover is disposed on the swivel plate, and the cushion can rotate 360 degrees on top of the base plate.

1 Claim, 4 Drawing Sheets

360-DEGREE SWIVEL CUSHION

BACKGROUND OF THE INVENTION (a) Field of the Invention

A 360 swivel cushion of the present invention relates to a swivel cushion, and more particularly to a swivel cushion capable of rotating 360 degrees and sliding in 4 directions. A user can arbitrarily rotate and shift position of the cushion, and therefore suited for usage by an office worker who has to sit for long periods, and for those aged and weak patients for whom getting around is inconvenient or as a cushion seat in automobile.

(b) Description of the Prior Art

Accordingly, a common cushion has an extensive range of applications. In day-to-day life, the cushion can be placed on a chair, on a seat of an automobile or on sickbeds. However, because a conventional cushion is structured so as to be fixed in position, and therefore impossible to rotate, immense inconvenience results when aged and weak or women and children for whom getting around is inconvenient or bed-ridden patients wish to shift position of their bodies, turn over or get down from bed, As a consequence, there is a wanting need for advancement in cushion design.

SUMMARY OF THE INVENTION

A primary objective of the present invention is to utilize a number of steel balls reposed within a swivel ball seat, and therewith slide on circular tracks configured on a base of a swivel plate, thereby carrying along a cushion and rotating and sliding on a base plate thereof, and thus providing a cushion with functionality to arbitrarily rotate 360 degrees and slide in four directions, enhancing and providing greater convenience to everyday life.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
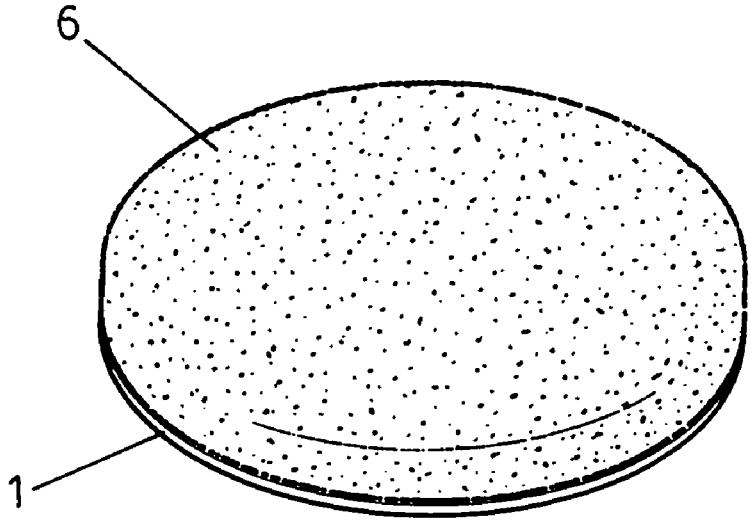
FIG. 1 shows a schematic drawing according to the present invention.
Figure 2:
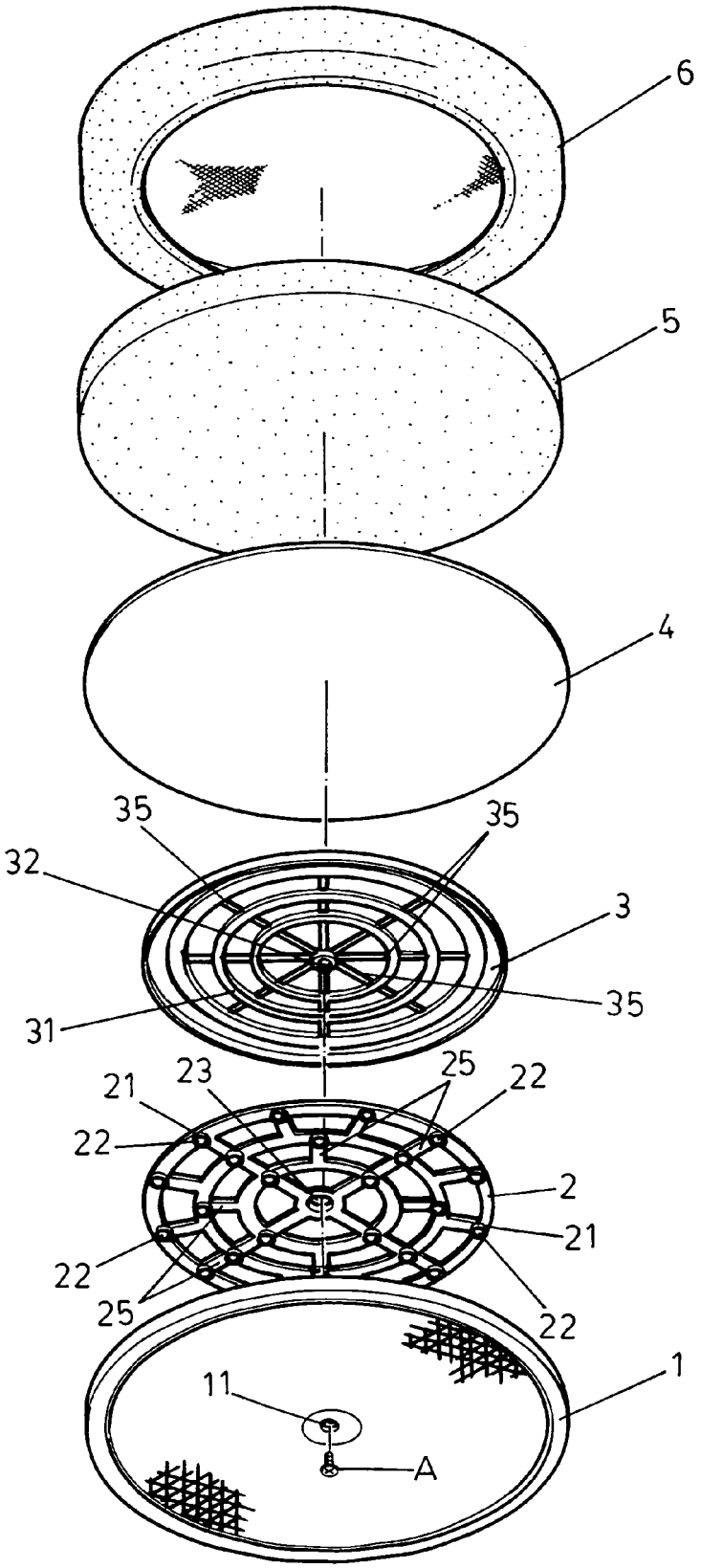
FIG. 2 shows an exploded elevational view according to the present invention.

Referring to FIGS. 1 and 2, which depict a 360-degree swivel cushion of the present invention comprising and constructed to include a base plate 1, a swivel ball seat 2, a swivel plate 3, a cushion 4, a foam rubber 5 and a cover 6. A perforation 11 is defined in a center of the base plate 1 for a screw A to pass therethrough. The swivel ball seat 2 comprises a circular web-like seat, upon which is configured a number of ball orifices 21. A steel ball 22 is embedded in each of the ball orifices 21; thereby 24 steel balls 22 are distributed on top of the web-like swivel ball seat 2. The swivel plate 3 is configured so as to lie on top of the swivel ball seat 2. Three circular tracks 31 of variant diameter are configured on a base of the swivel plate 3, thereby enabling the steel balls 22 to separately repose in the tracks 31. A screw hole 32 is defined in a center of a base of the swivel plate 3, and, upon the swivel ball seat 2 being disposed between the base plate 1 and the swivel plate 3, the screw A is made to pass through the perforation 11 of the base plate 1 and a central screw hole 23 of the swivel ball seat 2 and thereat screwed down within the screw hole 32 of the swivel plate 3.

The swivel seat 2 includes concentric rings of varying diameters that are connected by radial connecting portions 25, so that the swivel seat 2 is a one-piece unit, as illustrated in FIG. 2. The swivel plate 3 includes concentric tracks of varying diameters that are connected by radial connecting portions 35, as illustrated in FIG. 2.

Figure 3:
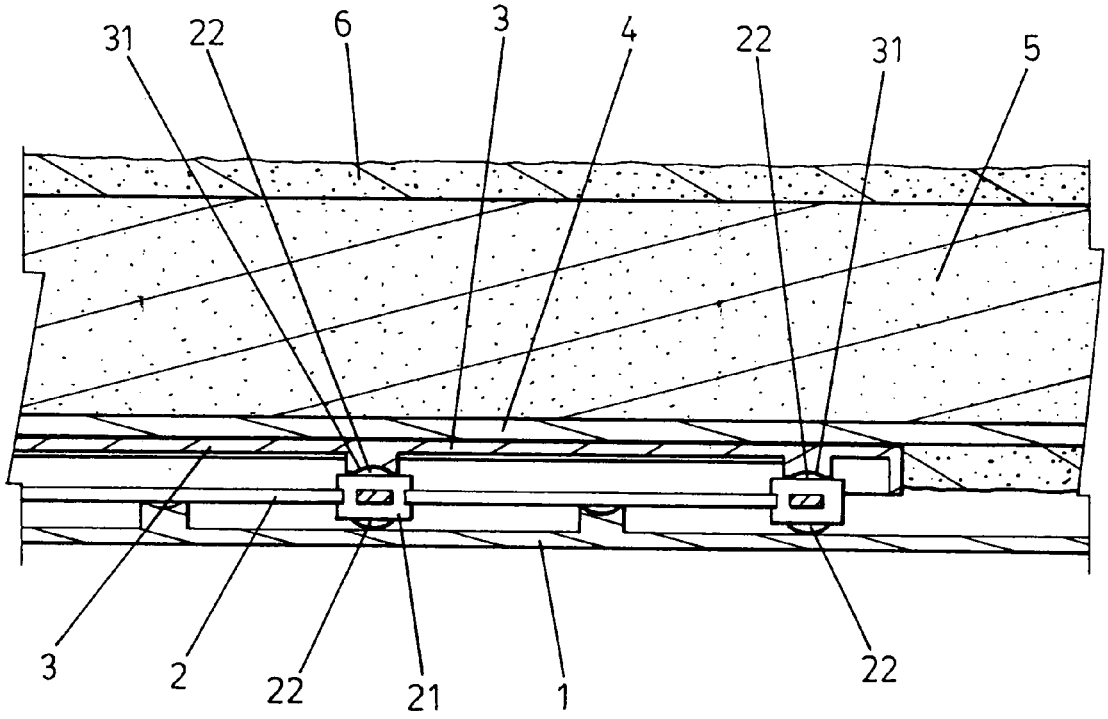
FIG. 3 shows a partial cross sectional view according to the present invention.

Referring to FIG. 3, which shows the cushion 4 fixedly adhered on top of the swivel plate 3. The foam rubber 5 is placed and adhered on top of the cushion 4, and the cover 6 is then made to fully cover the foam rubber thereon. The cover 6 completely wraps round a bottom of the 360-degree swivel cushion, and is designed for easy taking off to facilitate cleaning thereof.

Figure 4:
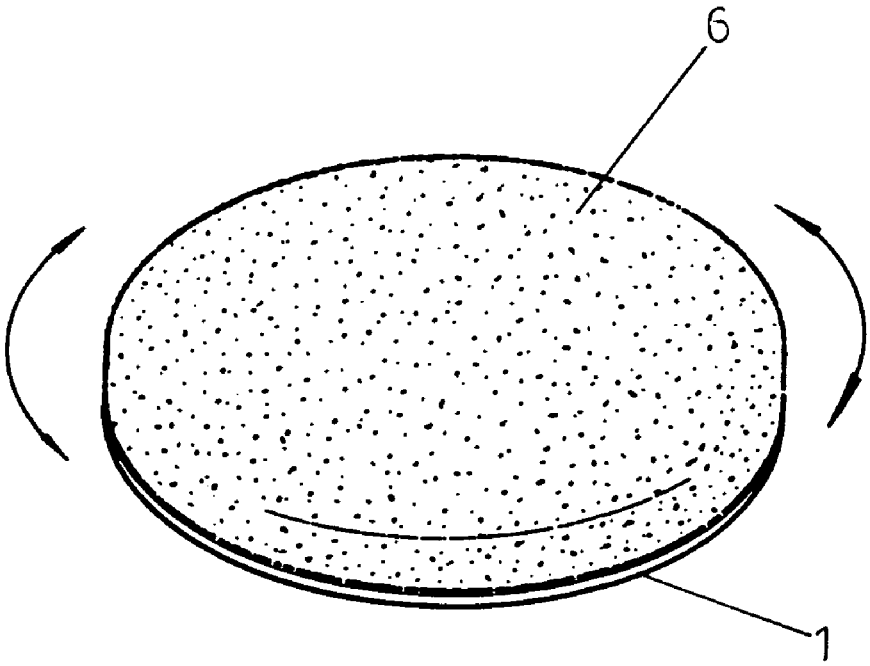
FIG. 4 shows an embodiment according to the present invention.

Referring to FIG. 4, which depicts the 360 degree swivel cushion of the present invention completely assembled, and thereby actualized for 360 degree rotation and slippage in 4 directions, whereby the swivel ball seat 2 is configured to carry along the swivel pan 3, the cushion 4, the foam rubber 5 and the cover 6, and thus realize rotating on top of the base plate 1 thereof.

In conclusion, the 360 degree swivel cushion of the present invention utilizes the swivel ball seat 2 disposed between the base plate 1 and the swivel plate 3, to actualize 360 degree rotation and arbitrary change in direction, thereby enhancing and providing greater convenience to daily life of chair-ridden persons, aged and weak, women, children and bedridden patients for whom getting around is inconvenient.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A 360 degree swivel cushion, comprising:

a base plate having a perforation at a center thereof;

a swivel ball seat comprising concentric rings of varying diameters that are interconnected by connecting portions, and configured with a number of ball orifices, a plurality of steel balls are embedded in said ball orifices, a central screw hole is positioned at a center of the swivel ball seat;

a swivel plate comprising a base, the base of the swivel plate having concentric tracks of varying diameters that are interconnected by radial connecting portions, thereby enabling the steel balls to roll within the tracks, a screw hole is further defined in a center of the base of the swivel plate;

a foam rubber is adhered on top of the cushion;

a cover covers the top of the foam rubber and exposed portions of the swivel cushion; and a screw passes through the perforation of the base plate and the central screw hole of the swivel ball seat and is secured to the screw hole of the swivel plate, so that the swivel ball seat secured to the cushion is rotatable by 360 degrees with respect to the base plate.

* * * * *